US006123213A

United States Patent [19]

Clive-Smith et al.

[11] Patent Number: 6,123,213

[45] Date of Patent: Sep. 26, 2000

[54] BEAM FOR A PLATFORM CONTAINER

[76] Inventors: Martin Clive-Smith; Christopher John Jones, both of Wootton Paddox, Leek Wootton, Warwickshire CV35 7QX, United Kingdom

[21] Appl. No.: 09/304,847

[22] Filed: May 5, 1999

[30] Foreign Application Priority Data

May 5, 1998 [GB] United Kingdom ..... 9809477
May 14, 1998 [GB] United Kingdom ..... 9810698

[51] Int. Cl.[7] ..... B65D 6/18

[52] U.S. Cl. ..... 220/6; 220/1.5

[58] Field of Search ..... 220/1.5, 6; 108/56.1, 108/55.1

[56] References Cited

U.S. PATENT DOCUMENTS 4,162,737 7/1979 Clive-Smith ..... 220/1.5
4,353,520 10/1982 Jansson ..... 248/346.3
4,807,774 2/1989 Karpisek ..... 220/6
4,966,085 10/1990 Howe ..... 108/55.1
5,398,832 3/1995 Clive-Smith ..... 220/1.5
5,720,228 2/1998 Clive-Smith ..... 108/55.1
5,755,472 5/1998 Clive-Smith ..... 294/67.1

*Primary Examiner*—Stephen Castellano
*Attorney, Agent, or Firm*—Young & Thompson

[57] ABSTRACT

A platform based container (11), has longitudinal side rails (16), fabricated from sheet steel, and of 'I'-section beam, with differential span, or width, opposed flanges (18, 48 and 19, 49), separated by an intervening web (35, 45), with a localized (side post-restraint, insertion) cut-out (36) in one flange, braced by a subsidiary flange (26), set at an intermediate web depth, and with a localized web bracing plate (32).

9 Claims, 7 Drawing Sheets

Figure 1A:
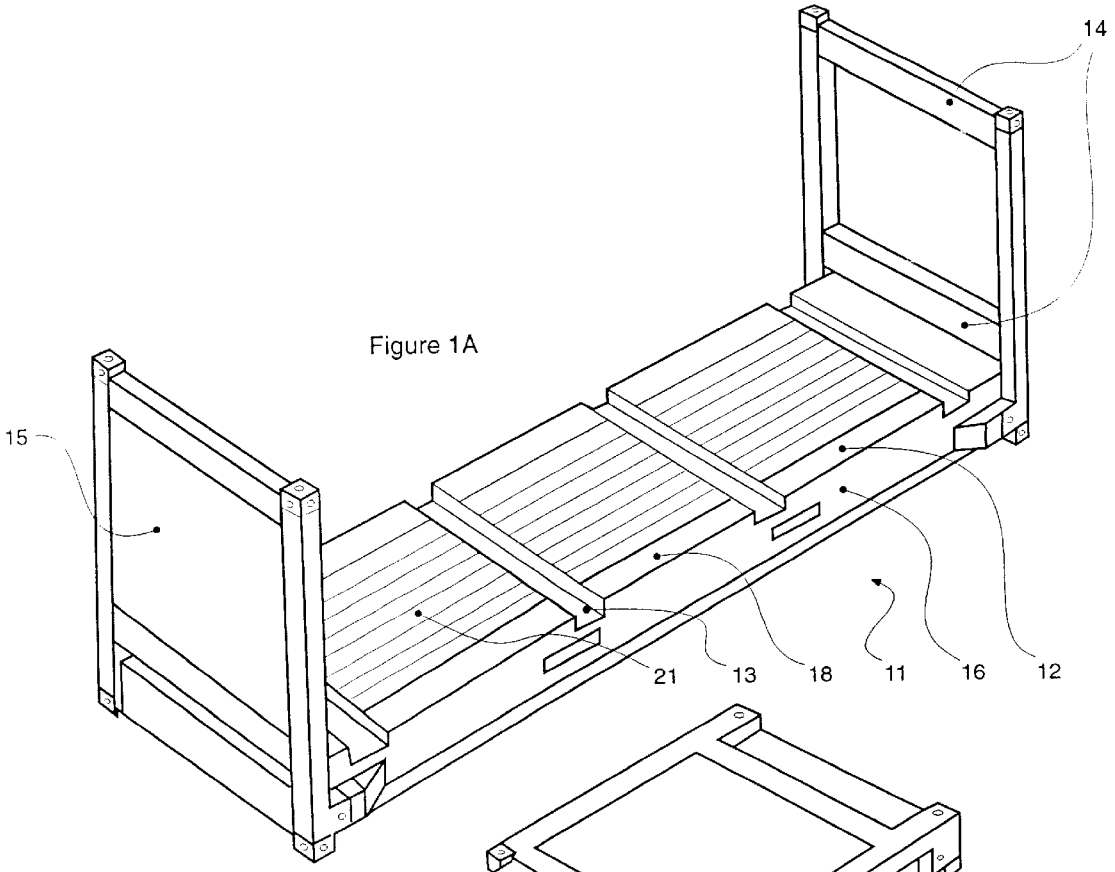

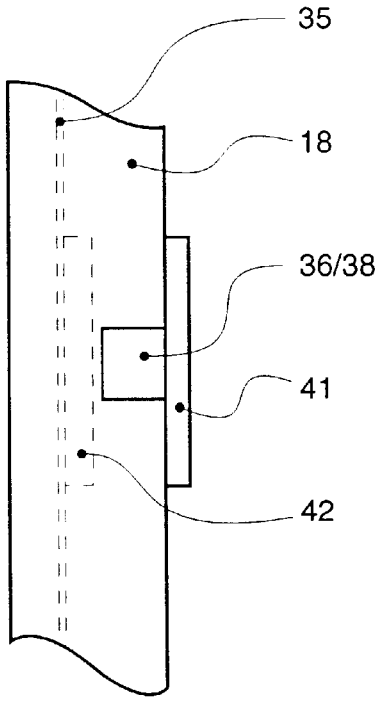
Figure 4A
Figure 4B
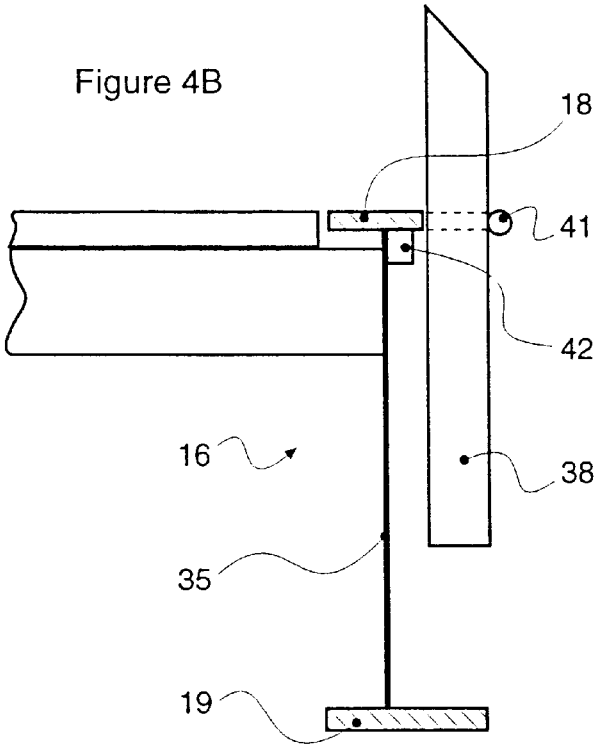

BEAM FOR A PLATFORM CONTAINER

In the field of (shipping) containers there is a type of container which is 'platform-based'.

The platform generally comprises a rectangular steel frame, floored with timber, or steel sheet.

The (longitudinal) chassis side rails, which were once made from hot-rolled 'I'-section, or channel-section beams, commonly available.

As market demands for lighter 'tare' weight began to influence design, the 'I' beams became fabricated from thinner steel—not easily being formed by hot rolling technology.

The platform based containers sometimes have (hinged or pivoted) end walls, foldable down upon, to overlie, or lie flush with, the base platform.

Such flush-folding is achieved by reception of transverse bracing framework of the end walls, in dedicated, transverse recesses in the base platform.

The local base depth intrusion of these recesses reduces the overall base strength, and raises local stress concentrations, where the sections change.

Thus additional weight of steel is needed to restore strength.

However, strength is not the only criteria for bases.

Thus, bases need to be rigid, so that, under payload, they do not sag—and so damage any containers the base might be sitting (stacked) upon.

The common way to maintain rigidity of a longitudinal side rail upper or top flange is to bridge the recess with a reinforcing element—which acts in bending.

However, such an approach is inefficient in preventing sag and reducing stress.

Other requirements are made of the top flanges.

These are commonly cut-away or relieved locally at intervals, to receive load lateral restraint stanchions, or braces, and lashing devices.

Again, the stress concentrations arising demand compensating weight in reinforcement elements.

It would be an advantage to configure the (side rail) flanges to reduce or counter the effects of stress concentration.

Timber, as a flooring material, is ideal, but is becoming increasingly expensive, as resources are limited.

Thus, a reduction in timber content would be an advantage.

An aspect of the present invention addresses the rigidity, tare weight, and strength of beams for use in platform based containers.

According to one aspect of the present invention, an 'I' section beam, [for a platform based container], has one [upper or top] flange wider, and of greater cross-sectional area, than another [lower or bottom] flange, the top flange being cut-away, or otherwise omitted, at localised recess zones, with the web locally braced or supported, by a bracing plate, gusset or 'shear block', connected to a secondary or intermediate flange, [generally parallel to the top flange,] across the recess.

Another aspect of the invention provides a platform based container, incorporating an 'I'-beam according to the immediately preceding paragraph.

Thus, a platform based container, according to an aspect of the invention, has an 'I' section (longitudinal) side rails, supporting a base platform, for load carriage, the side rails having one (upper) flange, wider than another, opposed (lower) flange, a recess, [cut] in an upper flange, to accommodate transverse frame member, of a hinged end-frame and so enable flush-folding of an end frame, upon the base platform; and a secondary flange, incorporated at the base of the recess, [parallel to the upper flange], and a reinforcement plate, in the intervening web.

There now follows a description of:

- some prior art 'flat-rack' or platform-based container examples; and
- some particular embodiments of various aspects of the invention, by way of example only;

with reference to the accompanying diagrammatic and schematic drawings, in which:

FIG. 1A shows a general perspective view of a so-called 'flat-rack' or platform-based container 11—that is a container with a platform base 12, and collapsible, panelled, end walls 15.

With such a collapsible flat-rack 11 in an erected condition—as depicted in FIG. 1A, the end walls 15 stand (locked) upright, from opposite ends of the base platform 12.

Figure 1B:
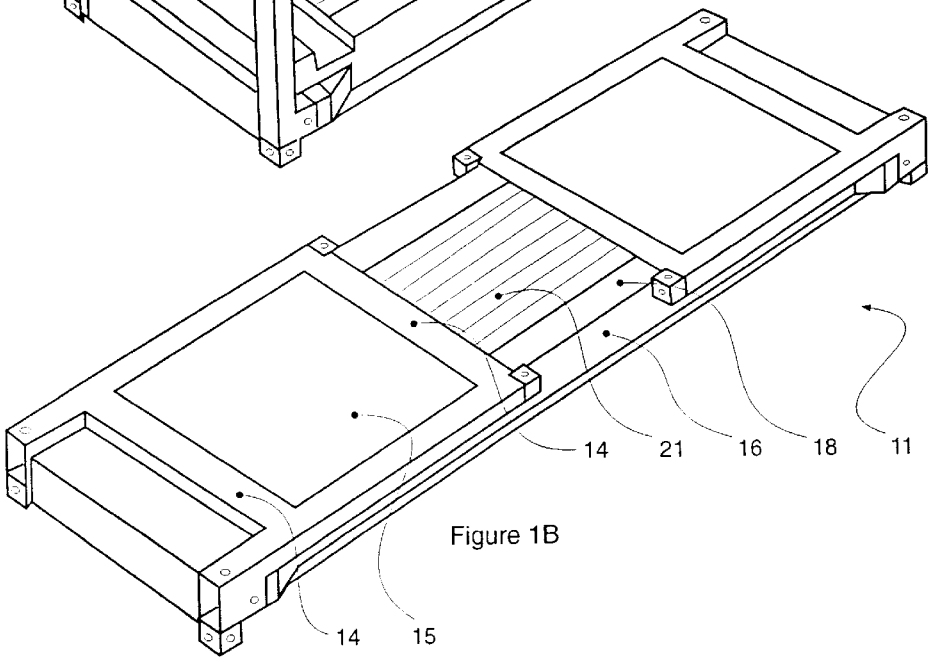

In a collapsed condition of the flat-rack 11—depicted in FIG. 1B—the end walls 15 are folded inwardly to overlie respective ends of the base platform 12.

Figure 2:
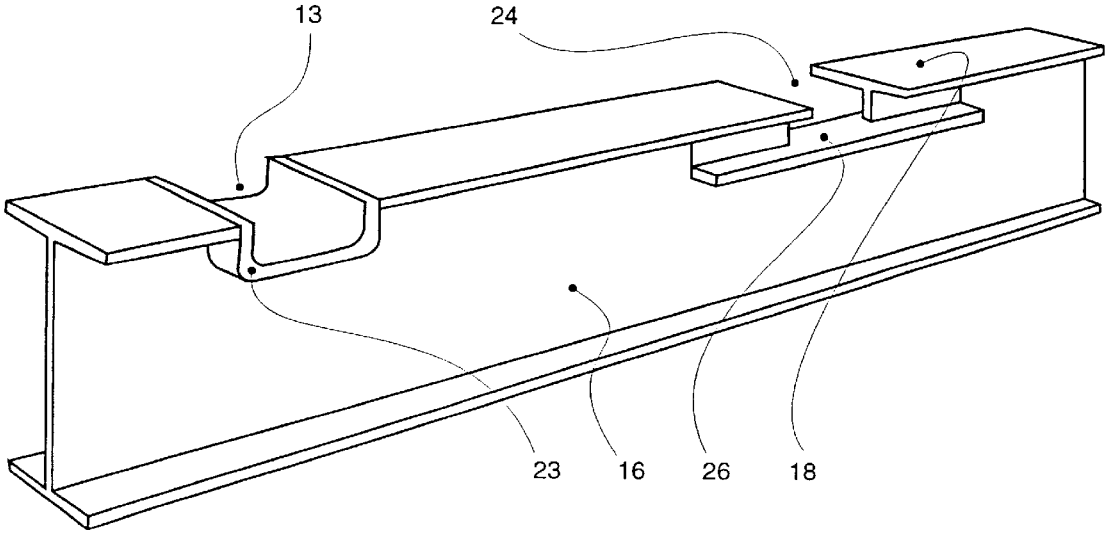

FIG. 2 shows a perspective view of part of an 'I'-beam 16, for use as a longitudinal side rail of the platform-based container of FIGS. 1A and 1B.

The beam 16 features a series of recesses 13, 24 (of different individual construction), in its upper or top flange, to accommodate transverse frame members 14 of the collapsed end walls 15, when folded to overlie the base platform 12.

Figure 3:
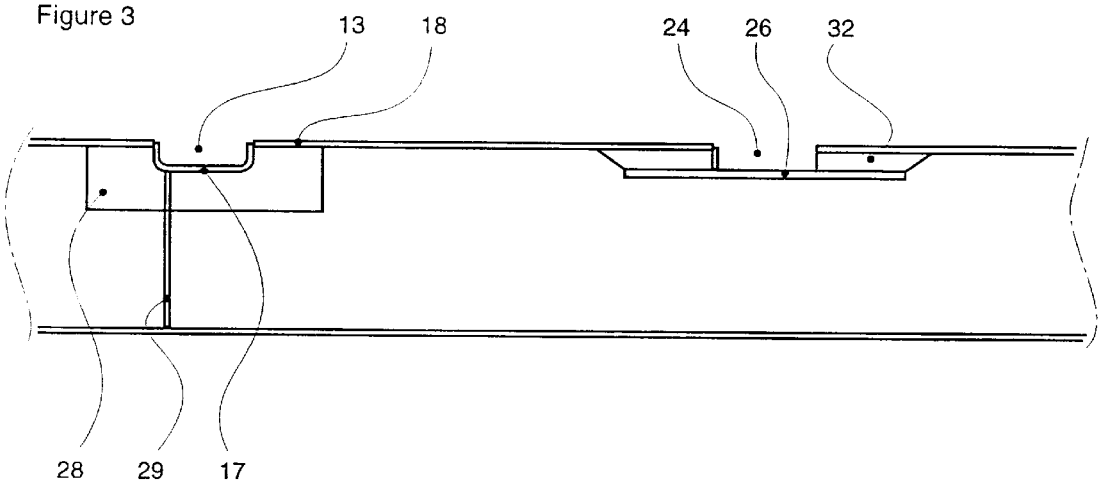
Figure 5A:
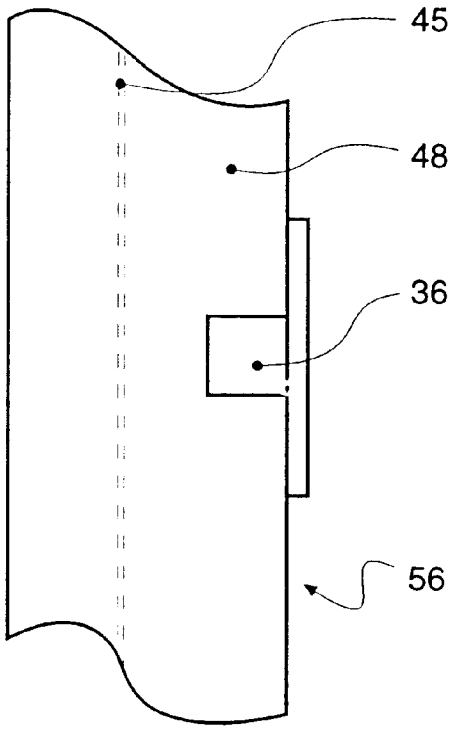
Figure 5B:
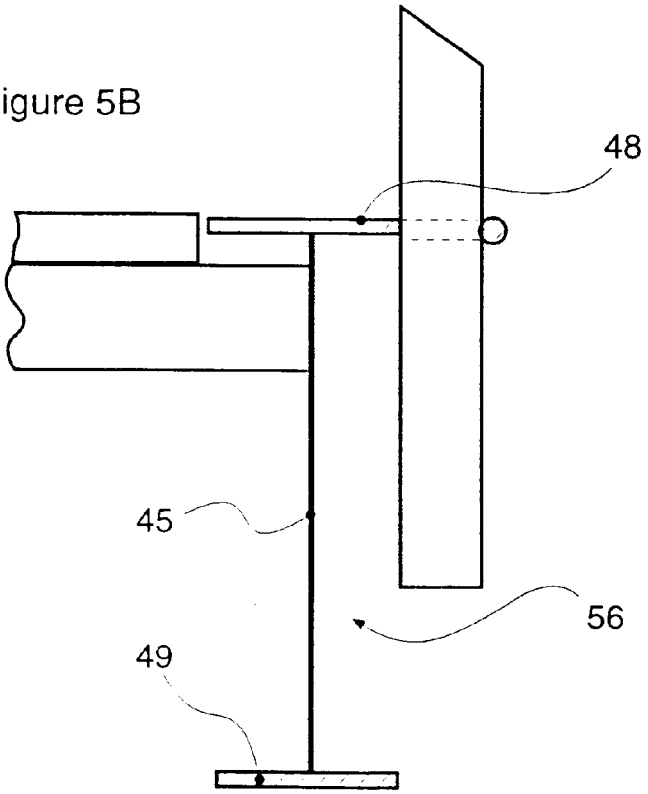
Figure 6:
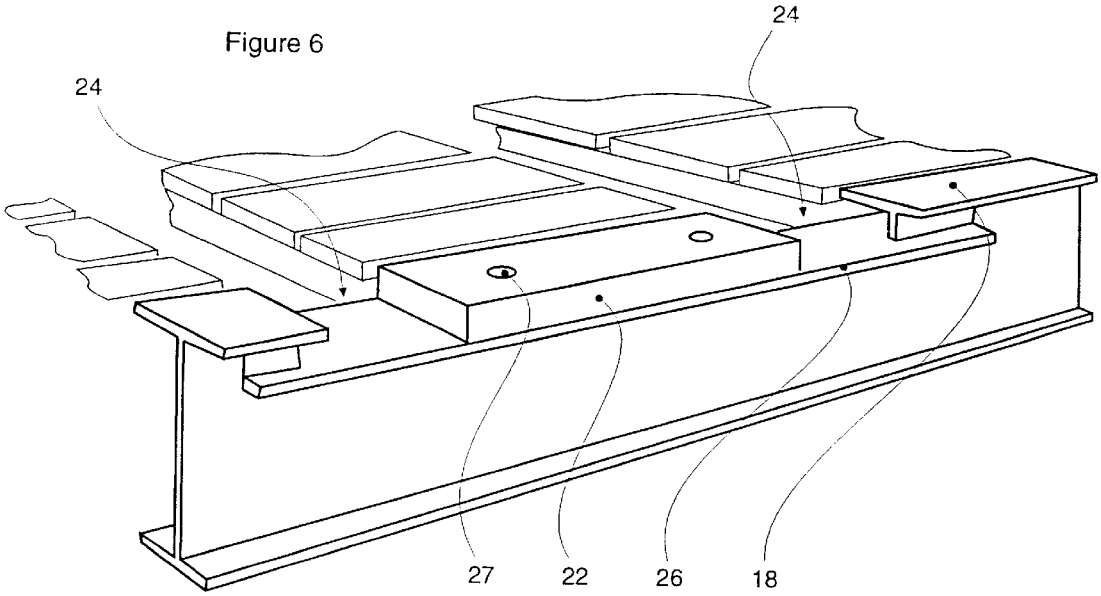
Figure 7:
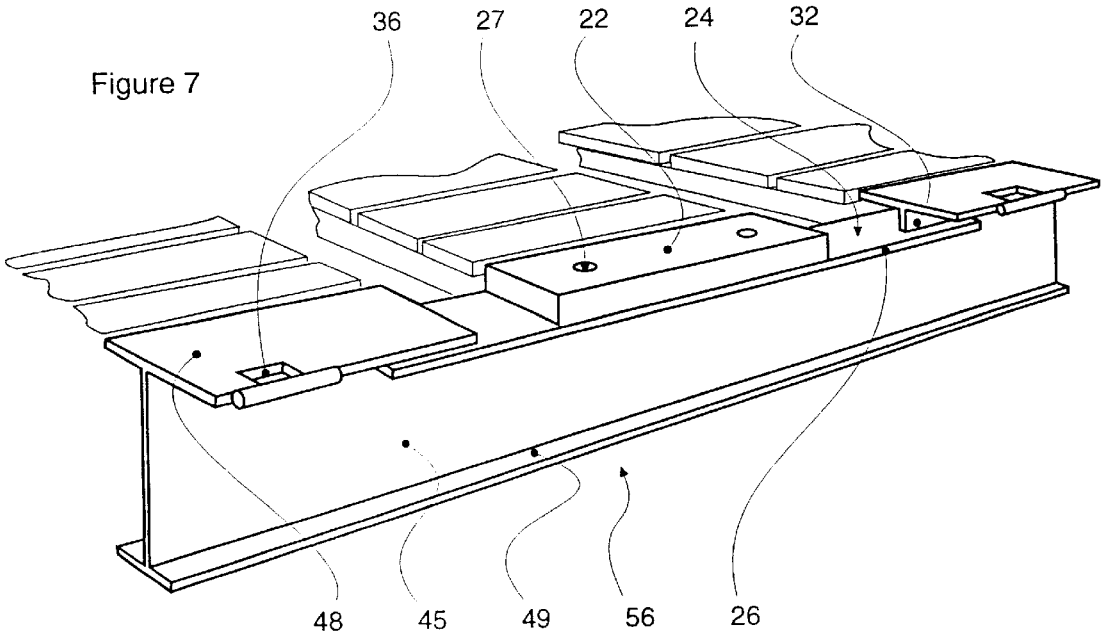

FIG. 3 shows a side elevation of the 'I'-beam of FIG. 2;

FIGS. 4A and 4B respectively show upper plan and cross-sectional views of a longitudinal side chassis rail, reflecting a prior art configuration;

FIGS. 5A and 5B respectively show corresponding upper plan and cross-sectional views of a longitudinal side chassis rail to FIGS. 4A and 4B, but of a configuration according to the invention—with differential upper and lower flange widths;

FIG. 6 shows a perspective view of part of an 'I'-beam, as shown In FIG. 2, with an extended recess in the upper or top flange and in-fill (platform or decking) blocks, according to another aspect of the invention; and FIG. 7 shows a perspective view of combination of aspects of the bespoke fabricated 'I'-beam of FIGS. 5A and 5B and the (deck) block in-filled, wide-span recess of FIG. 6.

Referring to the drawings:

FIG. 1 shows a typical prior art (collapsible) flat-rack 11, with rectangular platform base 12.

The base 12 is bounded, at opposite ends, by panelled, clad, or (solid) 'in-filled' 'folding', or 'collapsible', end walls 15, hinged or pivotally mounted, at each end of the base 12.

The base 12 has a series, in this case four, of transverse recesses 13, across its lateral span or width.

Into these recesses 13 can 'nest' transverse frame members 14, of the end walls 15, Thus, when folded down, the end walls 15 overlie or surmount, the base 12.

The cargo load support floor of the base 12 comprises a generally flat surface, in this case of timber slats or cladding 21, whose upper surface is generally level with the top surface of the upper flanges 18 of longitudinal side chassis rails 16.

When cargo (not shown) is carried upon the load platform 21 of the base 12, the major part of the load bearing chassis frame structure comprises the longitudinal side rails, configured as 'I'-beams, 16.

FIG. 2 shows a perspective view of part of such a longitudinal side chassis rail 16.

At one end, a recess 13 is formed with a pre-formed, for example, pressed, U-section piece 23.

At the other end, a recess 24, formed by locally cutting away or omitting the top flange 18, and sitting a local replacement parallel intermediate flange 26 somewhat below the top flange level 18 and above the bottom flange level 19.

In either case, the U-piece 23 and recess 24 represent local intrusions into the beam depth, undermining its resistance to bending moment.

In FIG. 3 an 'I'-beam 16 is shown in side elevation.

The 'pressing' 17 is welded to the upper flange 18, in order to maintain some structural flange continuity.

When the beam 16 is loaded (ie with cargo), the top flange 18 undergoes compression—and attendant bending—whereupon the recess 13 tends to distort, and in particular close-up.

The structure of the [recess] pressing 17; and additional web reinforcement, or bracing plates, or gussets 28, 29;

inhibit bending and attendant deformation of the recess 13.

In practice, the beam 16 proves very flexible at the recess 13 and highly stressed (locally).

In other known beam configurations, the pressing 17 is omitted altogether.

In order to compensate for this, the vertical, or upright, web bracing or reinforcement plate 28 increased—albeit to somewhat 'massive' proportions, in order to take the load.

However, this is a very heavy and costly solution—and one which does not improve the 'performance' of the recess.

An alternative configuration of recess 24—according to the invention—is formed by locally omitting, or removing, (by say cutting through), the flange 18.

Vertical shear, or web bracing gussets, or plates 32 connect the top flange 18 to an intermediate, or secondary, flange 26, which extends beyond the width, or span, of the (overlying) recess 24.

When loaded with cargo (not shown), the compression in the top flange 18 is carried, in shear, through the secondary flange 26.

It is found that both beam deflection and stress in the structure are reduced—achieving two desirable characteristics with a common structural feature, according to one aspect of the invention.

Another aspect of the present invention is shown in FIGS. 5A and 5B—and, for the purposes of comparison and background perspective, in relation to prior art, equivalent configurations are shown In FIGS. 4A and 4B.

FIG. 4A shows a typical longitudinal chassis side rail 16, in which the top flange 18 and the bottom flange 19, are of generally equal 'mass'.

This is because conventional 'I' section beams employed in such prior art chassis rails 16 are made by a hot-rolling process, largely for the building and construction industry.

Such a conventional 'I'-beam typically embodies 'thick' intervening webs 35 and 'balanced' opposite (upper and lower) flanges 18, 19.

This conventional 'I'-beam configuration is reflected in FIGS. 2, 3 and 6—but an alternative 'bespoke' fabricated beam configuration, described in relation to FIGS. 5A and 5B, in relation to side post restraint mounting slot provision, could be employed.

Reverting to FIGS. 4A and 4B, a requirement in some flat-rack bases 12, is for pockets 36—typically cut into the top flanges 18—in order to locate lateral load support stakes or posts 38—as lateral restraints against cargo sliding off the base.

In the known approach of FIGS. 4A and 4B, the strength lost by local removal of top flange 18, is compensated for somewhat by the addition of:

a bar 41, closing off the pockets, and a flange-to-web reinforcement plate 42.

However, so much of the flange 18 is lost, that the configuration once again proves inefficient in practice.

An embodiment of an improved beam according to another aspect of the invention is shown in FIGS. 5A and 5B.

Here the top flange 48, of a bespoke fabricated beam 56, according to one aspect of the invention, is very much wider—yet thinner—than the equivalent top flange 18 of a conventional beam (whether hot-rolled or fabricated).

The web 45 of such a bespoke fabricated beam 56, can be made thinner, because it is fabricated from steel sheet.

A lesser sectional area has been found sufficient for the bottom flange 49, of such a bespoke fabricated beam 56—than for an equivalent bottom flange 19 of a conventional beam 16—and is made thicker and narrower, better to resist damage.

Being wider, once the upper flange 48 is omitted, or removed, for example by locally cutting away, at a pocket 36, there remains a significantly larger proportion of its cross-sectional area left behind, to withstand the loads generated in it.

The result is a lighter weight beam, with greater rigidity and lower stress, than the beam shown in FIG. 4A.

Attempts have been made with such beams to make them lighter and more rigid by offsetting the flanges (somewhat) on either side of the web.

The result of this offset has been to undermine the benefit of a fabricated beam.

Generally, it is desirable for the flanges to extend somewhat upon both sides of the vertical web 45.

However, the pocket 36 need not be included as part of the top flange 48, when considering the relative positions of the web and flanges.

FIG. 6 shows a side elevation of a beam, similar to FIG. 3, but configured according to another aspect of the invention.

More specifically, the recess 24 is extended—substantially displacing, or substituting locally for, the flange 18, over a much greater span than hitherto.

Whereas this can be an advantage, for lower cost construction, there is now no load bearing surface where the flange 18 has been displaced.

In order to restore the load bearing surface, some robust device is needed, strong enough to support cargo, yet low enough in cost of manufacture, and, just as important, without causing corrosion traps.

Prior art configurations have used steel fabrications at this point, but such construction forms cavities prone to corrosion.

Furthermore, the fabrication needs to be very robust—and thus of heavy gauge steel—to withstand the impact of cargo.

This problem is addressed, according to the other aspect of the invention, by fitting a support block 22, of stout or robust support material, to the flange 26—but installed or fitted, after painting of the flanges 26.

The block 22 is supported on flange 26 and thus characteristically requires only compressive strength to support cargo.

A typical material would be timber, fixed, by screw fastenings 27, to flange 26.

Alternative materials for the block 22, include (recycled) synthetic plastics, a plurality of tubes, pipes or rods— possibly pre-painted metal, having multiple webs to brace against distributed cargo load.

FIG. 7 shows a combination of bespoke fabricated beam, with differential (span) upper and lower flanges as reflected in FIGS. 5A and 5B and enlarged span recess of FIG. 6.

The same reference numerals are used for corresponding features.

The overall arrangement is generally self-explanatory—in the context of the description of the various other drawings—and so will not be described in detail.

Component List

| | |
|---|---|
| 11 | flat rack |
| 12 | rectangular platform base |
| 13 | recess |
| 14 | transverse frame member |
| 15 | end wall |
| 16 | side rail/'I' beam |
| 17 | pressing |
| 18 | upper/top flange |
| 19 | lower/bottom flange |
| 21 | timber floor |
| 22 | block |
| 23 | U piece |
| 24 | recess |
| 26 | flange |
| 27 | fastening |
| 28 | vertical reinforcement plate/bracing plate/web gusset/shear block |
| 29 | vertical reinforcement plate/bracing plate/web gusset/shear block |
| 32 | vertical shear plate/bracing plate/web gusset/shear block |
| 35 | web |
| 36 | pocket |
| 38 | stake |
| 41 | bar |
| 42 | plate |
| 45 | web |
| 48 | upper/top flange |
| 49 | lower/bottom flange |
| 56 | bespoke fabricated 'I'-beam |

We claim:

1. A platform based container (11), with a 'I' section (longitudinal) side rails (16), supporting a base platform (12), for load carriage, the side rails having one flange (18, 48), wider than another, opposed flange (19, 49), a recess (24), in an upper flange, to accommodate transverse frame member (14), of a hinged end-frame (15) and so enable flush-folding of an end frame, upon the base platform; and a secondary flange (26), incorporated at the base of the recess, and a reinforcement plate (32), in an intervening web (35, 45).

2. A platform based container, with 'I' section side rails, a recess, in one flange, a secondary flange, incorporated at the base of the recess, a block, inserted in the recess, to provide load support, whilst leaving recess portions, to accommodate end frame collapse.

3. A platform based container, as claimed in claim 2, with one flange wider than another flange.

4. A platform based container, as claimed in claim 2, where the supporting block is of timber.

5. A platform based container, as claimed in claim 2, where the supporting block is of plastics.

6. A platform based container, as claimed in claim 2, wherein the supporting block comprises a plurality of rods, pipes or tubes.

7. A platform based container, as claimed in claim 1, with 'I' section side rails, with a top flange, with cut-outs for the insertion of side stakes, to restrain lateral load movement, upon the base platform, without undermining beam strength, or load-bearing capacity.

8. A platform based container, with 'I' section side rails, as claimed in claim 1, fabricated from 'thin' steel sheet.

9. An 'I' section beam, the beaming being, with one flange, wider than another, opposite flange, a recess in the top flange, and a secondary flange, incorporated at the base of the recess, parallel to the top flange, with a web reinforcement plate.

* * * * *